United States Patent [19]

Memmott et al.

[11] Patent Number: 4,862,780

[45] Date of Patent: Sep. 5, 1989

[54] APPARATUS FOR CUTTING SHEETS OF MATERIAL

[75] Inventors: James V. W. Memmott, Wethersfield, Conn.; Allan H. Fidler, Kitchener; Steven D. Singer, Waterloo, both of Canada

[73] Assignee: United Technologies Corporation, Hartford, Conn.

[21] Appl. No.: 161,879

[22] Filed: Feb. 29, 1988

[51] Int. Cl.[4] ..... B26D 7/02; B26D 7/18

[52] U.S. Cl. ..... 83/128; 83/151; 83/452; 83/566; 83/620; 83/682

[58] Field of Search ..... 83/139, 125, 124, 123, 83/126, 30, 27, 23, 464, 451–452, 454, 81, 78, 375, 374, 111, 140, 128, 566, 150, 567, 531, 145, 151, 682, 620; 156/247, 249, 264, 265

[56] References Cited

U.S. PATENT DOCUMENTS

| | | | |
|---|---|---|---|
| 115,157 | 5/1871 | Brown et al. . | |
| 126,295 | 4/1872 | Hidden . | |
| 557,821 | 4/1896 | Hull . | |
| 1,082,986 | 12/1913 | Wilder | 83/139 |
| 1,450,945 | 4/1923 | Furber | 83/923 X |
| 1,670,898 | 5/1928 | Messmer, Jr. | 83/139 |
| 1,808,116 | 6/1931 | McKissock | 156/265 |
| 2,171,482 | 8/1939 | Rosenberg | 83/452 |
| 2,322,726 | 6/1943 | Carfagno | 83/567 |
| 3,048,069 | 8/1962 | Berlin et al. | 83/123 |
| 3,137,188 | 6/1964 | Domka | 83/124 |
| 3,148,572 | 9/1964 | Lindholm | 83/923 X |
| 3,181,405 | 5/1965 | Coy | 83/123 |
| 3,517,580 | 6/1970 | Sturm | 83/923 X |
| 3,827,322 | 8/1974 | Saunders et al. | 83/139 |
| 3,850,064 | 11/1974 | Dwyer | 83/139 |
| 4,030,390 | 6/1977 | Heiting | 83/123 |
| 4,051,754 | 10/1977 | Harcuba et al. | 83/124 |
| 4,306,476 | 12/1981 | Saunders et al. | 83/117 |
| 4,480,507 | 11/1984 | Boogers | 76/107 |
| 4,656,901 | 4/1987 | Axford et al. | 83/522 |

*Primary Examiner*—Frank T. Yost
*Assistant Examiner*—Rinaldi Rada
*Attorney, Agent, or Firm*—Lloyd D. Doigan

[57] ABSTRACT

A cutting die (10), which has one or more blades (20) forming the perimeter of a ply (16) to be cut from a sheet of material (14), has a resilient insert (40) placed within the blades to detach the ply (16) from the material and from the cutting die (10) after the ply (16) has been cut from the material (14) and has a hook-like appendage (28) extending from the perimeter of the blades to grip the material after the plies have been cut therefrom.

15 Claims, 2 Drawing Sheets

APPARATUS FOR CUTTING SHEETS OF MATERIAL

DESCRIPTION

The government has rights in this invention pursuant to Contract No. F33615-85-C-5152 awarded by the Department of the Air Force.

TECHNICAL FIELD

This invention relates to a method and apparatus for cutting plies for a composite article.

BACKGROUND ART

Typically, a composite article is constructed of a plurality of plies. The plies are layered in register to conform to the plan shape of a finished article. The plies of some articles are cut from a resinous matrix preimpregnated composite sheet (called a prepreg). The cut plies are layered and cured in a molding die (usually at high temperature and pressure) to form the finished article. The prepreg sheets are supplied from a continuous roll. Each roll has a layer of paper positioned between each wrap thereof to prevent the wraps from sticking to one another.

The prepreg plies may be cut into desired shapes by a computer controlled cutter. The computer controlled cutter cuts each ply from a sheet according to programmed instructions which detail each shape. Computerized cutting has several drawbacks; the process is generally slow as each ply is cut individually, and it is difficult to verify whether complete and proper cuts have been made because each cut ply remains within the prepreg waste (or "skeleton") after cutting. It is particularly important to have complete cuts passing through the prepreg to avoid manual intervention to cut the plies from the skeleton, and to allow automated machinery, which is used to stack the plies, to lift the cut plies from the skeleton without interference therefrom.

Steel rule dies have been used to simultaneously cut a plurality of plies from a plurality of stacked prepreg sheets. Steel rule dies are generally comprised of a plurality of knife edges that are set into a backing board. The knife edges form the perimeter of a shape of a ply to be cut. The cutting process includes; unrolling a roll of prepreg to cut sheets therefrom, layering (or stacking) several sheets on top of one another, utilizing the steel rule die to cut the desired plies, separating each ply from the stacks thereof, marking each ply so that each ply may be properly placed (laid up) to form the article, and removing the paper from each ply prior to laying up each ply. Such a process is time consuming, labor intensive and prone to error.

Accordingly, there remains a continuing need in the art for an improved method and apparatus for cutting plies of material.

DISCLOSURE OF INVENTION

It is an object of the invention to provide a cutting method apparatus which cuts a plurality of plies reliably and efficiently.

It is a further object of the invention to be able to verify that a ply is completely cut from a skeleton.

It is a further object of the invention to provide a method of cutting that is conducive to automated laying up of the plies for each article.

It is a further object of the invention to remove the paper layer disposed between the wraps of the material before cutting.

According to the invention, a cutting apparatus includes: a cutting die having a plurality of blades extending therefrom, the blades forming the perimeter of a ply; an ejector within the perimeter of the blades to detach each ply cut from a sheet of material by the die from within the perimeter of the cutting die after the blades of the die have cut the ply; and, a holding means depending from the blades outside the perimeter thereof to hold the skeleton of the material after cutting so that a complete and proper cut may be verified by separating the cut plies from the skeleton after the cut has been made.

According to a feature of the invention, the ejector is comprised of a resilient material such as foam rubber.

According to a feature of the invention, a cutting board is provided against which the cutting die cuts the plies, the cutting board having a plurality of stakes extending therefrom to register the cut plies thereupon.

According further to the invention, a method of cutting the plies is provided comprising; placing a sheet of material between the cutting die and a cutting surface, pressing the cutting surface and cutting die together thereby inducing the cutting die to cut a ply in the sheet, and while separating the cutting die from the cutting surface simultaneously holding the skeleton on the outside of the perimeter of the blades and detaching the ply from within the perimeter of the blades so that the completely cut plies are left upon the cutting board.

According further to the invention, a paper backing layer is removed from the sheet of material before cutting.

These and other objects, features and advantages of the present invention will become more apparent in light of the detailed description of a best mode embodiment thereof, as illustrated in the accompanying drawing.

BEST MODE FOR CARRYING OUT THE INVENTION

Figure 1:
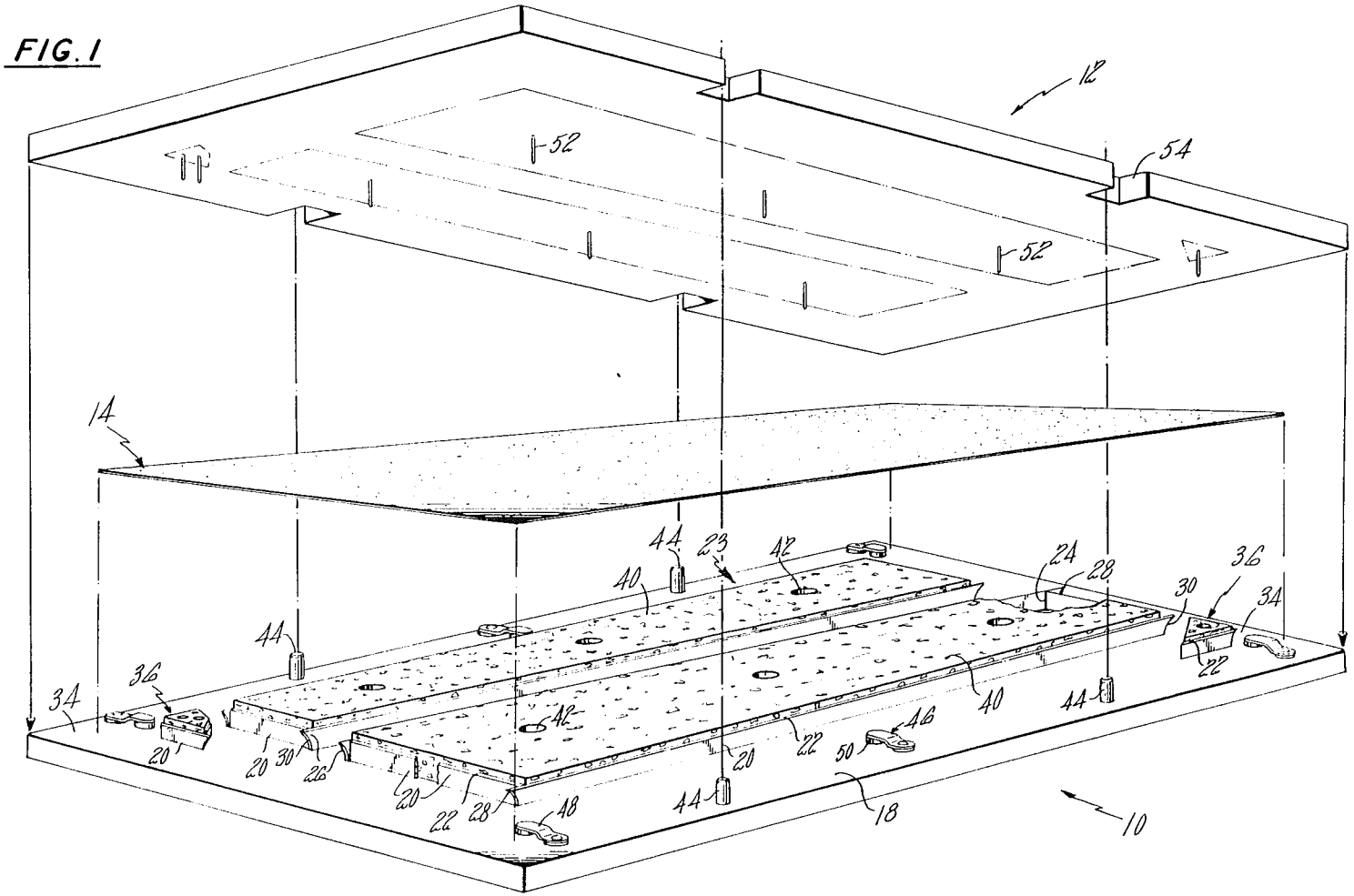
FIG. 1 is a perspective view of a cutting die, a cutting board and a sheet of material before the material is cut, the cutting board and cutting die employing of the invention.
Figure 2:
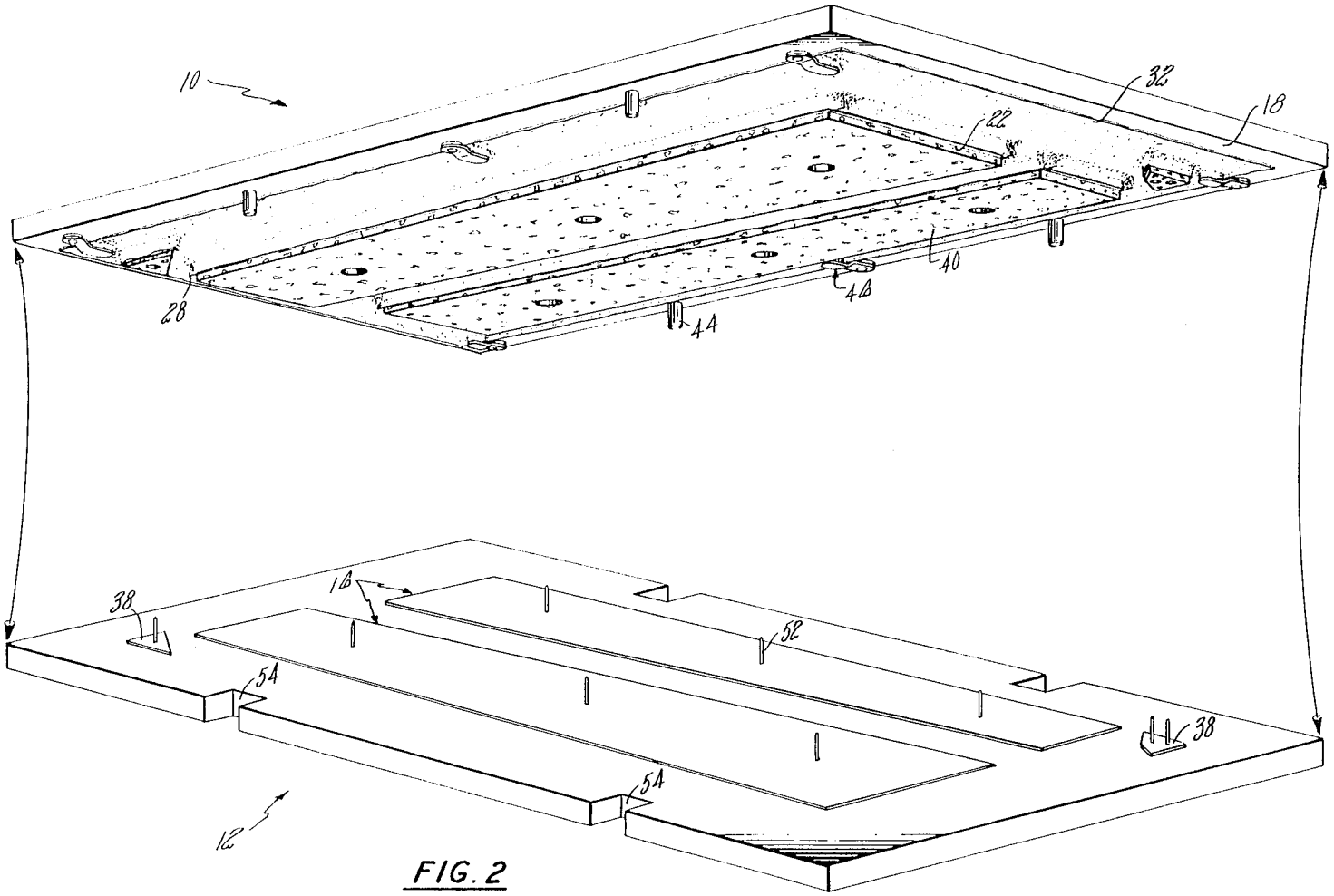
FIG. 2 is a perspective view of the cutting board and cutting die of FIG. 1 after the sheet of material has been cut.

Referring to FIGS. 1 and 2, a cutting die 10 and cutting board 12 embodying the concepts of the present invention are shown. The cutting board and cutting die are used to cut plies 16 from sheets of material 14 such as prepreg (an interwoven graphite and fiberglass material which is impregnated by a polyimide resin system). The plies 16 are used to construct composite articles (not shown). One of ordinary skill in the art will readily appreciate that such a cutting board and cutting die may be utilized to cut materials other than prepreg.

The cutting die 10 is comprised of a rigid backing board 18 which holds a plurality of blades 20 having knife edges 22. The blades, which are constructed of a steel banding material, are conventionally set within the backing board to form the perimeter 23 of the plies 16 to be cut. Generally, a separate blade is used to form each edge of the perimeter. The blades are either welded or brazed at their intersections 24 (i.e. at the corners of the perimeters) to close the perimeter. Some of the blades and their corresponding knife edges have portions 26 extending beyond the intersections of the blades. Such portions 26 have a hook-like appendage 28 having a curved inner surface 30. The appendage 28 helps the cutting die 10 grip the skeleton 32 of the material after cutting as will be discussed infra. Opposing corners 34 of the cutting die have blades which form a perimeter 36 that cuts a locating ply 38 as will be discussed infra.

An insert 40 of closed cell, medium density, resilient material, such as a foam rubber is placed within the perimeter 23 of the blades. The insert protrudes above a plane formed by the knife edges 22. The insert protrudes above the plane of the knife edges a sufficient distance to ensure that the insert pushes the plies 16 from within the perimeter 23 of the blades 20 after cutting. The insert may include holes 42 to allow the insert to compress evenly. Additionally, the insert 40 is coated with a thin layer (not shown) of a release agent, such as tetraflouroethylene to minimize the possibility that a material (such as prepreg) sticks to the insert 40.

The backing board 18 of the cutting die 10 has four, conventionally mounted, locating pins 44 extending therefrom as will be discussed infra. A plurality of clamps 46, each comprising a pivotally mounted band spring 48 and a mounting block 50, are disposed about the periphery of the backing board to hold a sheet of material as will be discussed infra.

The cutting board is constructed of an extruded, molybdenum disulfide filled, nylon available from the Norton-Performance Plastics Company of Wayne, N.J. under the tradename of Vekton ®. The cutting board is relatively hard, wear resistant, and non-adherent so that it withstands repeated cutting and so plies cut thereon may be readily removed. A plurality of stakes 52 extend through the cutting board in approximate register with the position of the plies that are cut thereon as will be discussed infra. The cutting board has four notched portions 54, each notched portion adapted to receive a locating pin 44 therein to place the cutting die 10 in approximate register with the cutting board 12.

In operation, the sheet of material 14 is placed upon the cutting die 10 over the knife edges 22. The material is then aligned (utilizing the locating pins 44 as a guide) on the cutting die and mounting blocks 50 so that the orientation of the fibers within the material meet the requirements of the article. The material is then secured to the mounting blocks (and the cutting die thereby) by pivoting the band springs 48 to clamp the sheet of material between the band springs 48 and the mounting blocks 50. After the sheet of material is secured, the cutting die is inverted and brought into contact with the cutting board. The locating pins 44 of the cutting die are located within the notches 54 of the cutting board so that the cutting board and cutting die and the stakes 52 of the cutting board and the perimeters 23 of the blades are in approximate register. Registration between the cutting board and cutting die is not exact to avoid consistently cutting in one place on the cutting board. Cutting in one place might score the board causing the material to stick within the board or fail to be fully cut. Both conditions are most undesirable.

The cutting die and cutting board are then transported through a conventional roller press (not shown). The roller press presses the cutting board and die together thereby; forcing the knife edges 22 (including the portions 26 extending beyond the perimeter of the blades) through the material 14 to cut the plies 16 (including the locating plies 38) from the sheet of material, and compressing the insert 40. After the cutting board and cutting die pass through the roller press, the cutting die is lifted vertically above the cutting board (See FIG. 2). As the cutting die is lifted, the plies are separated from the perimeters 23 of the knife edges 22 of the cutting die and the skeleton 32 of the material by the insert 40. The inserts, which are no longer compressed, recovers their normal dimensions to protrude above the plane of the knife edges to force the cut plies out of the cutting die. The stakes 52 in the cutting board tend to grip the cut plies and hold them in register for further processing as will be discussed infra. During the pressing by the roller press, the hook-like appendage 28 penetrates the material 14. The material cut by the hook-like appendage tends to close about the curved inner portion 30 of the hook-like appendage. As a result, in conjunction with the normal friction between the perimeter of the blades and the skeleton, the skeleton 32 tends to adhere to the blades and is removed with the cutting die as the cutting die is lifted from the cutting board. The cut plies are left on the cutting board.

Generally, the skeleton 32 is removed from the cutting die, and the cut plies, which are held in place by the stakes 52, are sent with the cutting board to be used in constructing a composite article. At another station (not shown) a computer controlled optical scanner (not shown) identifies the position of the locating plies 38 on the cutting board and then uses a data base to determine the position of the other plies 16. The computer may then control a robot (not shown) to pick up the plies and properly layer them to construct a preform of the composite article.

Since each ply 16 is separated from the cutting die by the insert and from the skeleton 32 by the removal of the skeleton with the cutting die, it is simple to optically inspect whether a ply has been properly cut. Incomplete cuts may necessitate the stoppage of the assembly process thereby requiring manual intervention. Time and materials may be wasted and labor expenses may increase. Further, the invention facilitates automatic production of articles by permitting the use of automatic machines that are adapted to pick up and layer the cut plies.

Although the invention has been shown and described with respect to a best mode embodiment thereof, it should be understood that various changes and modifications may be made without departing from the spirit and scope of this invention as defined by the following claims.

We claim:

1. A cutting die having one or more blades disposed thereon, said blades forming a perimeter of a ply and being adapted to cut the ply from a sheet of material, said die comprising:

detaching means disposed within said perimeter of said blades for detaching said piece from said cutting die and from said sheet after said ply has been cut, and means extending from said blades for grasping said sheet after said ply has been cut.

2. The cutting die of claim 1 further comprising;

a plurality of clamps disposed about said perimeter for holding and registering said sheet against said blades.

3. The cutting die of claim 1 further comprising;

a plurality of locating blades disposed upon said die and forming one or more perimeters for cutting plies used to determine a position of other plies cut by said die.

4. The apparatus of claim 1 wherein said detaching means comprises:

resilient material disposed within the perimeter of said blades, said material protruding above a plane formed by knife edges of said blades.

5. The apparatus of claim 4 wherein said resilient material is foam rubber.

6. The apparatus of claim 1 wherein said means extending from said blades comprises:

an appendage for hooking said sheet of material.

7. An apparatus for cutting a ply from a sheet of material comprising:

a cutting die having one or more blades disposed thereon, said one or more blades forming a perimeter of a ply, a cutting board, said cutting board and cutting die being adapted to receive a sheet of material therebetween and to be pressed together so that said blades of said cutting die cut plies from said material against said cutting board;

detaching means within said perimeter of said blades for detaching said ply from said cutting die and material sheet as said cutting board and cutting die are separated, and means extending from said perimeter of said blades for grasping said sheet after said ply has been cut.

8. The apparatus of claim 7 wherein said detaching means comprises:

resilient material disposed within the perimeter of said blades, said material protruding above a plane formed by knife edges of said blades when said cutting die is out of contact with said cutting board.

9. The apparatus of claim 8 wherein said detaching means is foam rubber.

10. The apparatus of claim 7 further comprising:

said cutting die having a plurality of pins disposed about a periphery thereof, and said cutting board having a plurality of notches disposed within edges thereof, said pins being adapted to be located within said notches such that said cutting board and said cutting die are in approximate register.

11. The apparatus of claim 10 wherein said cutting board further comprises;

a plurality of spikes extending therefrom for gripping said plies after said plies are cut by said cutting die, said spikes being in register with said perimeters of said cutting die when said cutting die and cutting board are in said approximate register.

12. The apparatus of claim 7 further comprising;

a plurality of clamps disposed about said perimeter for holding and registering said sheet against said blades.

13. The apparatus of claim 7 further comprising;

a plurality of locating blades disposed upon said cutting die and forming one or more perimeters for cutting plies used to determine a position of other plies cut by said die.

14. The apparatus of claim 7 wherein said cutting board further comprises;

a plurality of spikes extending therefrom for gripping said plies after plies are cut by said cutting die.

15. The apparatus of claim 7 wherein said means extending from said blades comprises:

an appendage for hooking said sheet of material.

* * * * *

UNITED STATES PATENT AND TRADEMARK OFFICE

CERTIFICATE OF CORRECTION

PATENT NO. : 4,862,780

DATED : September 5, 1989

INVENTOR(S) : James V.W. Memmott, Allan H. Fidler, and Steven D. Singer

It is certified that error appears in the above-identified patent and that said Letters Patent is hereby corrected as shown below:

Claim 1, line 62, after "from said" insert --perimeter of said--.

Signed and Sealed this

Eighteenth Day of December, 1990

*Attest:*

*Attesting Officer*

HARRY F. MANBECK, JR.

*Commissioner of Patents and Trademarks*